US008463151B2

(12) United States Patent
Kurohata

(10) Patent No.: US 8,463,151 B2
(45) Date of Patent: Jun. 11, 2013

(54) IMAGE FORMING APPARATUS

(75) Inventor: Takao Kurohata, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 275 days.

(21) Appl. No.: 12/862,358

(22) Filed: Aug. 24, 2010

(65) Prior Publication Data

US 2011/0052241 A1 Mar. 3, 2011

(30) Foreign Application Priority Data

Aug. 27, 2009 (JP) ..... 2009-196668

(51) Int. Cl.
*G03G 15/00* (2006.01)

(52) U.S. Cl.
USPC ..... 399/81

(58) Field of Classification Search
USPC ..... 399/75, 81–87; 358/1.12–1.18
See application file for complete search history.

(56) References Cited

U.S. PATENT DOCUMENTS

| | | | | |
|---|---|---|---|---|
| 7,933,035 | B2 * | 4/2011 | Okada et al. | 358/1.15 |
| 2004/0218197 | A1 | 11/2004 | Vliembergen et al. | |
| 2007/0180159 | A1 * | 8/2007 | Takahashi | 710/8 |
| 2008/0049251 | A1 * | 2/2008 | Shimada | 358/1.15 |

FOREIGN PATENT DOCUMENTS

| | | | |
|---|---|---|---|
| JP | 2002-225389 | A | 8/2002 |
| JP | 2004-348713 | A | 12/2004 |

* cited by examiner

*Primary Examiner* — Hoan Tran
(74) *Attorney, Agent, or Firm* — Buchanan Ingersoll & Rooney PC

(57) ABSTRACT

An image forming apparatus includes an image forming section which performs image formation according to execution of a job, a storage section which can store two or more jobs, a display section to perform display, and a control section by which the operations of the image forming section and the display section are controlled, and the job is stored and managed in the storage section, and which performs these two or more jobs in a prescribed order. According to the setting conditions and the operating state of each of jobs, before and after the job, in the execution order, this control section creates guidance and displays this guidance on the display section. According to, or referring to, the guidance, the user is guided to perform processes. Working efficiency is enhanced because the operator knows easily a process or timing required in order to operate without stopping print operation.

29 Claims, 14 Drawing Sheets

STATE OF SHEET ABSENCE IN STACKER

STATE 1 OF SHEET PRESENCE IN STACKER

STATE 2 OF SHEET PRESENCE IN STACKER

LOWERED STATE WITH SHEETS IN STACKER

LOWERED STATE WITHOUT SHEETS IN STACKER

FIG. 4

143

COPY | SCAN | SAVE | READ OUT | JOB LIST | MACHINE CONDITION

PLEASE SELECT JOB IN THE LIST
DETAILS CAN BE CONFIRMED
SET COPY NUMBER 0123

OUTPUTTING STATE 0200/0200
0012 KONICAMINOLTA@BUSINESS
MEMORY RESIDUAL QUANTITY 99.999%
DOCUMENT COUNT 22
NUMBER OF RESERVED JOBS 5
HDD RESIDUAL QUANTITY 100.000%

JOB | OUTPUT HISTORY | TRANSMISSION HISTORY | PRE-OUTPUT HISTORY | DEVELOPMENT STATE

| OPERATING STATE | MODE | STATE | SHEET NUMBER | COPY NUMBER | RESIDUAL SHEET NUMBER | TIME (MINUTES) | USER NAME | FILE NAME |
|---|---|---|---|---|---|---|---|---|
| 0012 | COPY | PRINTING | 1000 | 100 | 1000 | 34 | Konicaminolta@b | Mirage-M_GUI |
| 0013 | PRINT | RESERVED | 1000 | 1000 | 1000 | 34 | Konuma Shigeo | Mirage-M_GUI |
| 0014 | COPY | RESERVED | 1000 | 1000 | 1000 | 34 | ------ | ------ |
| 0015 | PRINT | RESERVED | 1000 | 1000 | 1000 | 34 | Konuma Shigeo | Mirage-M_GUI |
| 0016 | COPY | RESERVED | 1000 | 1000 | 1000 | 34 | ------ | ------ |
| 0017 | COPY | RESERVED | 1000 | 1000 | 1000 | 34 | ------ | ------ |
| 0018 | PRINT | RECEIVING | 1000 | 1000 | 1000 | 34 | Konuma Shigeo | Mirage-M_GUI |
| 0019 | COPY | RESERVED | 1000 | 1000 | 1000 | 34 | ------ | ------ |
| 0020 | COPY | RESERVED | 1000 | 1000 | 1000 | 34 | ------ | ------ |

0001/0001 | DETAIL | ▲ | PRIORITY OUTPUT | ▼ | PRIORITY HOLDING | COLLECTIVE DELETION | DELETE | STOP

| HOLDING | MODE | STATE | SHEET NUMBER | COPY NUMBER | RESIDUAL SHEET NUMBER | TIME (MINUTES) | USER NAME | FILE NAME |
|---|---|---|---|---|---|---|---|---|
| 0001 | PRINT | HOLDING | 1000 | 1000 | 1000 | ------ | Konuma Shigeo | Mirage-M_GUI |
| 0002 | COPY | HOLDING | 1000 | 1000 | 1000 | ------ | ------ | ------ |
| 0003 | PRINT | HOLDING | 1000 | 1000 | 1000 | ------ | Konuma Shigeo | Mirage-M_GUI |
| 0004 | PRINT | HOLDING | 1000 | 1000 | 1000 | ------ | Konuma Shigeo | Mirage-M_GUI |

0001/0001 | TICKET EDITION | ▲ | HOLDING RELEASE | ▼ | COLLECTIVE RELEASE

DATA IS BEING RECEIVED  KONICAMINOLTA@BUSINESS

IMAGE FORMING APPARATUS

This application is based on Japanese Patent Application No. 2009-196668 filed on Aug. 27, 2009 with the Japanese Patent Office, the entire content of which is hereby incorporated by reference.

BACKGROUND OF THE INVENTION

This invention relates to an image forming apparatus which performs image formation based on image data, and in which sequential execution is possible by managing a plurality of registered jobs.

In image forming apparatuses, such as a copying machine, a printer, a facsimile machine and multi-functional properties of these which perform image formation based on image data, it is possible to store the image data obtained by reading a document for example in a storage device, such as a memory. Moreover, generally, registration of two or more jobs is possible for these image forming apparatuses, and these jobs are performed in order of priority.

A conventional image forming apparatus is known, in which, a job is predicted and display is conducted for information when carrying out two or more jobs continuously. For example, a display informing of end-time and a display informing of the timing when sheets are exhausted, display for informing that a job will stop on the way since there is no specified sheet, display for informing the timing by predicting when sheets on which image formation has been conducted fill in an ejection place, and a job will stop on the way, is known.

To be more specific, when recording materials run short to complete the job, the image forming apparatus which establishes a display of predicted time to run out of the recording material and in which it is shown whether output space will be lost, for example, is proposed (refer to Unexamined Japanese Patent Application Publication No. 2004-348,713). Moreover, the image forming apparatus which displays with different display modes which are classified by color is proposed so that it can be judged whether the reserved job is executable or nonexecutable at a glance (Unexamined Japanese Patent Application Publication No. 2002-225,389).

However, with the conventional image forming apparatus, the operation is conducted for only informing of the timing when a job is completed or a job is stopped, or that the job cannot be performed, and thus, a procedure so as to make the nonexecutable job to be executable, for example, is not displayed.

Therefore, the user may perform the suitable process by solving the cause which prevents the apparatus from performing the job, and needs to eliminate the execution impossibility, and such judgment may be difficult for the user. Moreover, if a suitable process is not carried out and the state is left as it is, it may make the job to stop on the way and interfere with the operation of continuous image formation.

Based on the background of the above-mentioned situation, an object of the present invention is to offer an image forming apparatus which can enhance working efficiency by making it possible to process continuously without stopping on the way, when performing two or more registered jobs.

SUMMARY

To achieve at least one of the abovementioned objects, an image forming apparatus reflecting one aspect of the present invention includes the following.

An image forming apparatus of the 1st embodiment among the embodiments of the present invention, includes an image forming section which performs image formation according to execution of a job, a storage section which can store two or more jobs, a display section which performs display, and a control section by which the operation of the above-mentioned image forming section and the above-mentioned display section are controlled and the above-mentioned job is stored and managed in the above-mentioned storage section, and which executes these two or more jobs in the prescribed order. Further the control section is characterized by creating guidance and displaying this guidance on the display section according to the setting conditions and the operating state of each of jobs before and after the job in the execution order.

BRIEF DESCRIPTION OF THE DRAWINGS

FIG. 4 shows an example of job control screen of a JOB list screen.

DETAILED DESCRIPTION OF THE PREFERRED EMBODIMENT

Figure 1:
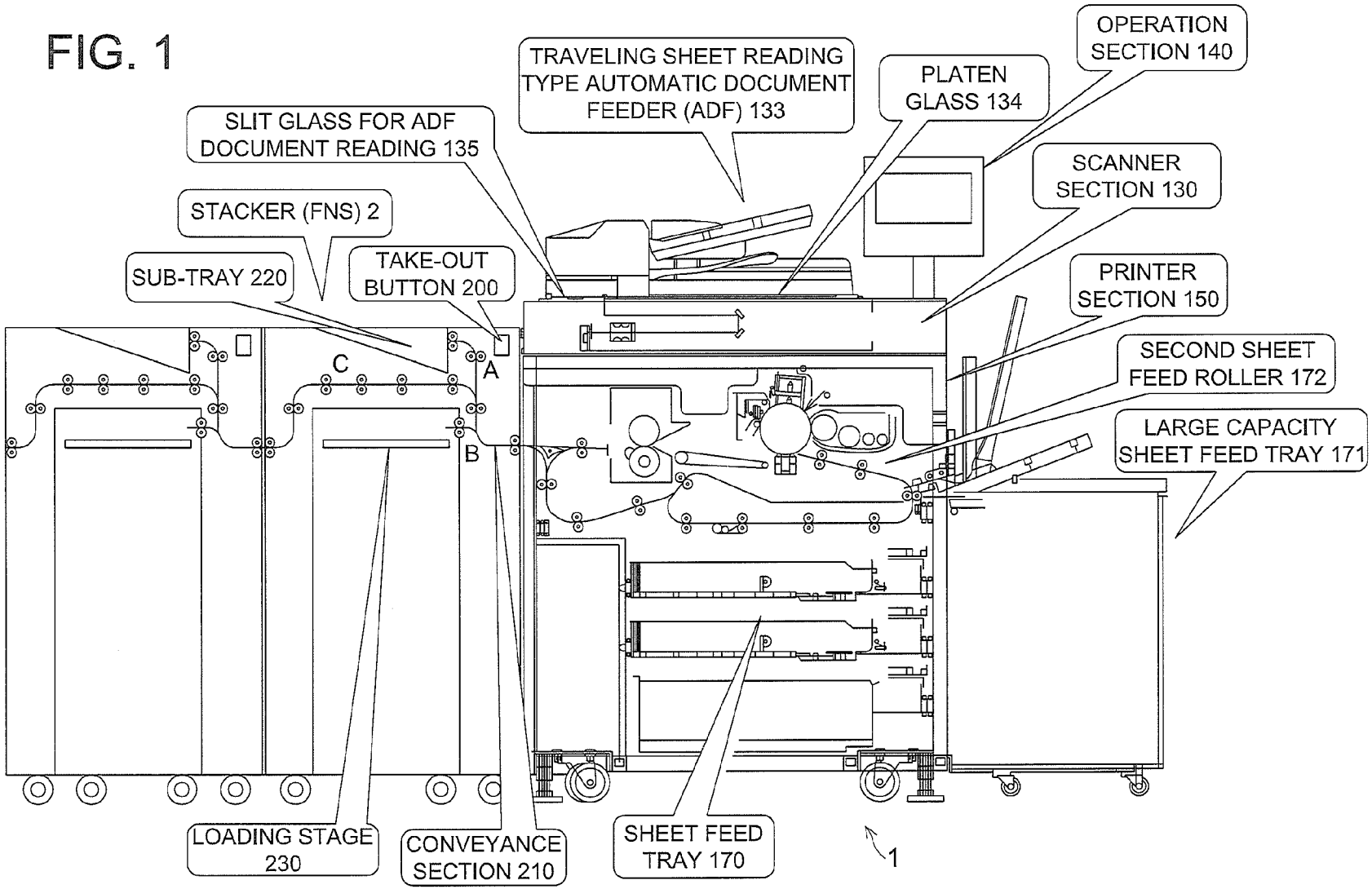
FIG. 1 shows the cross section through the center of the whole image forming apparatus in an embodiment of the present invention.

To be more specific, according to the above-mentioned embodiment of the present invention, for the job to be performed based on the prescribed order, with reference to the setting conditions and the operating states of jobs before and after the job, the guidance according to the result is displayed on the display section. Plural jobs can be efficiently performed because the operator carries out processes by according to or referring to the guidance. Therefore, the working efficiency in image formation is improved.

The sheet ejection destination setting information which specifies the sheet ejection destination of the sheet on which image formation has been conducted and post processing setting information as the above-mentioned setting conditions are cited. One or more post-processing apparatuses which perform post-processing of sheets on which image formation has been made can be connected to the image forming apparatus. The classification of post-processing apparatus is not particularly limited and for example, the apparatuses which perform a saddle stitching process, a wrapping binding process, a side-stitching process (a stapling process and a punching process), and a stacking process are cited.

As the above-mentioned operating state, a job reserved state, a job execution state, a job-end state, the existence of an image formation suspension factor are cited.

Although the content of the above-mentioned guidance is not limited to specific ones as in the present invention, guidance showing a procedure for continuing two or more jobs without suspending the above-mentioned image formation operation is cited. As the above-mentioned procedure, the exchange plan of the execution orders of the above-mentioned jobs, the timing at which outputted sheets are removed can be cited. Moreover, it is also possible to correlate time with the above-mentioned procedure, and to display them on a display section.

It becomes possible to continue and perform two or more jobs by following the guidance which shows change of the order of the job execution order or the like as a procedure, without suspending the image formation operation. Moreover, by correlating a procedure with time, the operator can predict the processing time or time of day of each job, and can perform the operation. It becomes possible to follow the time as a rough indication, and to make more efficient operation possible.

The display section can display a list and schedule of the above-mentioned job, and can display the above-mentioned guidance in accordance with these displays. Moreover, guidance can be displayed on another screen.

If setting conditions and the operating state of the above-mentioned jobs have any change after once creating the above-mentioned guidance, it can be changed again according to the setting conditions and the operating states of jobs before and after the job in the execution order. Thereby, suitable guidance can be created and displayed according to the situation.

As a change of the operating state of the above-mentioned jobs, registration of a new job, deletion of the job, execution of the job, termination of the job or exchange of the execution order of the jobs, resolution or occurrence of the operation suspension factor of the above-mentioned image formation, or the like are cited.

In the operation section where input by an operator is possible, the operation about the above-mentioned job can be performed. This operation section may be prepared independently from a display section or may serve as both a display section and an operation section.

Further, when creating guidance, the setting conditions and the operating states of the jobs are referred to one by one according to the execution order, and it is judged whether there are factors due to which execution of the job cannot be performed or restrictions to removal of sheets on which image formation has been conducted. Then, based on these judgment results, the above-mentioned guidance can be created or changed.

An embodiment of the present invention is described below, based on an accompanying drawing.

FIG. 1 shows the mechanical constitution of an image forming apparatus 1, which is an embodiment, and gives the description below.

(Image Forming Apparatus 1)

The image forming apparatus 1 is provided with an operation section 140, a scanner section 130, and a traveling sheet reading type automatic document feeding device (ADF) 133, a platen glass 134, a slit glass 135 for the ADF document reading, a printer section 150, a sheet feed tray 170, a large capacity sheet feed tray 171, and a second feed roller 172.

The operation section 140 is equipped with a LCD 141 as a display section, which displays various operation input screens, the status display of the apparatus, the operation situation of each function or the like via a touch-panel composition. In other words, the operation section 140 functions as the display section and operation section of an embodiment of the present invention.

The traveling sheet reading type automatic document feeding device (ADF) 133 is attached to the upper part of the scanner section 130 enabling it to open and close, and carries out automatic feeding of every document sheet to the document reading position on the slit glass 135 for ADF document reading. The automatic document feeding device (ADF) 133 discharges the document to a document sheet ejection tray, when reading of it by the scanner section 130 is completed.

Further, in the scanner section 130, the document laid on the platen glass 134 can be read. The scanner section 130 is constituted of a light source, a CCD, or the like and reads the image of a document by carrying out image formation via the reflected light which has been employed for the illumination scanning from the light source to the document, and carrying out photoelectric conversion of the image. The scanner section 130 changes the read image into digital image data via an A/D converter.

The printer section 150 forms the image corresponding to image data onto a sheet according to an electrophotography process. The printer section 150 is constituted including LD 151 and a drum.

By irradiating the drum surface charged by the electrifying device based on the inputted image data with a laser light, LD 151 forms an electrostatic latent image, and a developer (toner) is provided by the developing device for this electrostatic latent image whereby the image is developed. The toner image formed on the drum is transferred by the transfer section onto the sheet which is fed through the second feed roller 172 from the sheet feed tray 170 or the large capacity sheet feed tray 171. Heat fixation of the transferred image is carried out by the fixing unit. The sheet on which image formation has been carried out is discharged to the post-processing apparatus.

(Post-Processing Apparatus)

In this embodiment, stackers 2 and 3 are connected in series to the image forming apparatus 1 as the post-processing apparatuses.

The stackers 2 and 3 have the same composition and, in the following description, a composition is described about the stacker 2.

The stacker 2 is provided with a take-out button 200, a conveyance unit 210, a sub-tray 220, and a loading stage 230. The conveyance unit 210 has branches of a path A which extends to the sub-tray 220, a path B which extends to the loading stage 230, a bypass route C which bypasses the sub-tray and the loading stage.

Next, with reference to FIG. 2, the circuit block of the image forming apparatus 1 will be described.

The image forming apparatus 1 is equipped with a digital copier body which has an overall control section, a scanner section 130, an operation section 140, and a printer section 150 as main compositions. Furthermore, the image forming apparatus 1 is equipped with an image processing device (print & scanner controller) 160 to process the image data outputted and inputted between the exterior through a LAN or the like, which is not illustrated.

In the total control section, a DRAM control IC 111 is connected to a PCI bus 112, and an image control CPU 113 is connected to the DRAM control IC 111. To this image control CPU 113, a nonvolatile memory 117 is connected, in which a program which operates this CPU, setting data of the image forming apparatus 1, data of process control parameters and others are contained.

The image control CPU 113 controls the overall image forming apparatus 1, and calls up the data such as setting data, process control parameters, or the like having been registered into the nonvolatile memory. Then the image control CPU 113 follows the content of registered data, operates and sets up the image forming apparatus, and is equivalent to the control section of the embodiment of the present invention.

Further, the above-mentioned scanner section 130 is equipped with CCD 131 which performs optical reading, and the scanner control section 132 which performs the whole control of the scanner section 130. The screen control section 132 connects with the above-mentioned image control CPU 113 so that a serial communication may be enabled, and receives control via the image control CPU 113. After this, data processing is conducted in the reading processing section 116, for the image data read by the above-mentioned CCD 131, and a prescribed compression processing is made by a compression IC 118. The compression IC 118 is connected to the above mentioned DRAM control IC 111.

The above-mentioned operation section 140 is equipped with a touch-panel type LCD 141 and an operation-section-control section 142. Furthermore, in the above-mentioned operation section 140, the above-mentioned LCD 141 and the operation-section-control section 142 are connected, and the operation-section-control section 142 and the above-mentioned image control CPU 113 are further connected. Control of the operation section 140 is performed by the image control CPU 113 by this composition. In the operation section 140, the input of operation control requirements, such as a setting and an operating command in the image forming apparatus 1 are possible. Furthermore, the display of content of the settings, the displays about JOB (a list display, a schedule display, or the like), the display for guidance and other display are possible, and are controlled by the described image control CPU 113. This operation section 140, can be operated as a key which calls up the JOB. Moreover, in the operation section 140 the operations (new registration, deletion, exchange of orders) about the JOB can be inputted.

The DRAM control IC 111 is connected to the image memory 120 which is composed of a compression memory 121 and a page memory 122. The image data acquired in the above-mentioned scanner section 130 and the image data acquired from the exterior are stored in the image memory 120. As mentioned above, the image memory 120 is a storage area for data such as image data, and functions as a storage section which stores the job information to be printed.

Furthermore, a decompression IC 125 which decompresses the compressed image data is connected to the DRAM control IC 111. And a writing processing section 126 is connected to this decompression IC 125. The writing processing section 126 is connected with an LD (laser diode) 151 of the printer section 150, and processes the data used for an operation of the LD 151. Moreover, the printer section 150 is equipped with the printer control section 152 which controls the entire printer section 150, and the printer control section 152 is connected with the above mentioned image control CPU 113, and receives the commands. Furthermore, the stacker 2 is connected to the printer section 150. The stacker 2 is equipped with the first stacker control section 250 which controls the whole stacker 2, and is connected to the above-mentioned printer control section 152. The circuit block of the stacker 2 will be described later.

Further, a DRAM control IC 161 of the above mentioned image processing device 160 is connected to above-mentioned PCI bus 112 connected to the above-mentioned DRAM control IC 111. In the image processing device 160, an image memory 162 is connected to the DRAM control IC 161, and a controller control CPU 163 and a LAN interface 165 are connected to the above-mentioned DRAM control IC 161. The LAN interface 165 is connected to a LAN which is not illustrated.

In the stacker 2, to the above mentioned first stacker control section 250, take-out button 200, a door sensor 201, a sheet upper limit sensor 233, a stage lower limit sensor 231, a stage upper limit sensor 232, and a sheet ejection sensor 240 are connected controllably.

Moreover, the stacker 3 is connected to the sheet ejection side of the stacker 2. The second stacker control section 350, with which the stacker 3 is equipped, is connected to the above-mentioned first stacker control section 250 controllably.

Next, fundamental operations of the image forming apparatus 1 are described.

First, the process for accumulating image data in the image forming apparatus 1 will be described.

When the image of a document is read and image data are generated in the scanner section 130 in the image forming apparatus 1, the image of the document is optically read from a document by the CCD 131 in the scanner section 130. In this case, the scanner control section 132 which receives a command from the image control CPU 113 performs operation control of CCD 131. As for the image read by CCD 131, data processing is made in the reading processing section 116. The image data for which data processing has been carried out is compressed by the command of DRAM control IC with the prescribed method in the compression IC 118, and is stored in the compression memory 121 through the DRAM control IC 111.

Further, when acquiring image data from the exterior, the image data transmitted through a LAN from an external instrument or the like is stored in the image memory 162 by the DRAM control IC 161 through the LAN interface 165. The data of the image memory 162 are sent to compression IC 118 one by one through the DRAM control IC 161, the PCI bus 112, and the DRAM control IC 111 to be subjected to compression processing. The data are stored in the compression memory 121 through the DRAM control IC 111.

When the image forming apparatus 1 performs image output (copy output) based on the image data acquired above, the image data stored in the compression memory 120 are sent out to the decompression IC 125 through the DRAM control IC 111, and data are decompressed. The decompressed data are sent out to the writing process section 126 through the DRAM control IC 111, and the writing on the drum is performed in the LD 151. In the printer section 150, in response to the command of the image control CPU 113, control of each part, such as conveyance of a sheet, transfer, and fixation are performed by the printer control section 152, and the sheet is conveyed to the stacker 2. When there is a loading command, the sheet on which image formation was made according to the command is loaded into the stacker 2 or the stacker 3.

Moreover, when image data is temporarily stored in the image memory 120, it stores the data according to the abovementioned process. Plural jobs can also be stored in the image memory 120 one by one, and control (such as control of the execution order, the setting conditions, and the operating state) of this job is made by the image control CPU 113. These control matters can be stored in the nonvolatile memory 117, for example. In this case, the nonvolatile memory 117 also functions as the storage section of the embodiment of the present invention. Moreover, it is also possible to record the above-mentioned control matters in the image memory 120.

Next, operations of the stackers 2 and 3 will be described. In addition, since the stackers 2 and 3 have the same composition, description is made for the stacker 2 here.

The door, which is not illustrated, is prepared at the front side of the stacker 2. When taking out sheets accumulated in the loading stage 230 after image formation, the door is opened by depression operation of take-out button 200, and it is closed at the time of image formation.

A door sensor 201 detects whether the door of the stacker 2 is open, and outputs the detection signal to the first stacker control section 250. The sheet upper limit sensor 233 detects the location of the uppermost sheet on the loading stage 230, and outputs the detection signal to the first stacker control section 250. It is detected whether the loading stage 230 has moved to the position of the lower limit by the stage lower limit sensor 231. Then the stage lower limit sensor 231 outputs a detection signal to the first stacker control section 250.

The stage upper limit sensor 232 detects whether the loading stage 230 has moved to the upper limit position, and outputs a detection signal to the first stacker control section 250.

The sheet ejection sensor 240 detects whether the sheets after the image formation have been discharged to the sub-tray 220 or to the loading stage 230. Then the sheet ejection sensor 240 outputs a detection signal to the first stacker control section 250.

The first stacker control section 250 controls each part in the stacker 2 according to control of the image control CPU 113. To be more specific, based on the detection signal of the sheet upper limit sensor 233, the stage lower limit sensor 231, and the stage upper limit sensor 232, the first stacker control section 250 drives the loading stage 230 and adjusts it up or down. Moreover, the first stacker control section 250 controls the conveyance unit 210 based on the detection signal of a door sensor 201 and the sheet ejection sensor 240. Then, the first stacker control section 250 controls ejection of the sheets to the sub-tray 220 or the loading stage 230.

The change of a loading state in a stacker is described for the stacker 2 as an example based on FIGS. 3*a*-3*e*.

Figure 3A:
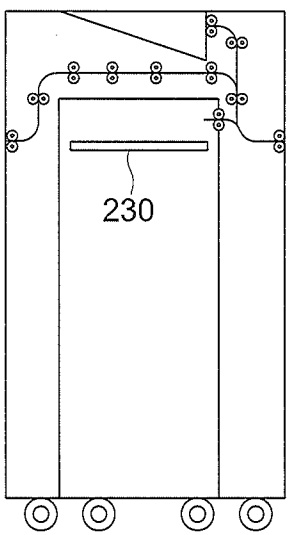
FIGS. 3*a*-3*e* show the loading states in a stacker.
Figure 3B:
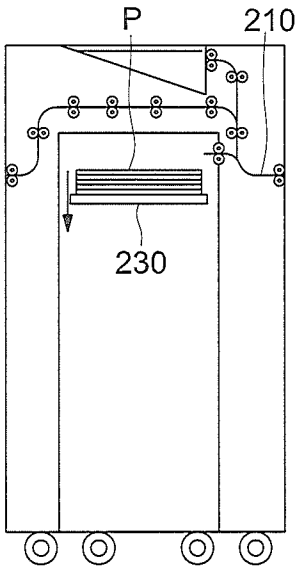
Figure 3C:
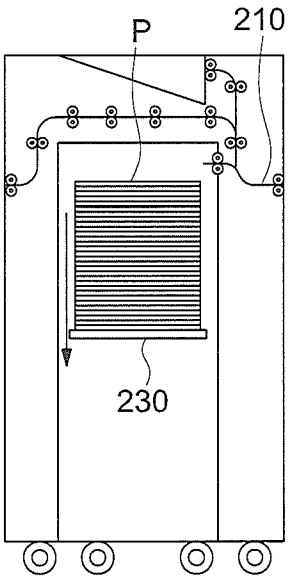

FIG. 3*a* shows the state where the sheet is not loaded on the loading stage 230. If image formation is performed based on the job, the path is switched in the conveyance unit 210 in the stacker 2, as shown in FIG. 3*b*. The sheets P on which image formation has been carded out are loaded on the loading stage 230 to be in the state 1. The detection of the upper limit of the loaded sheets P, with the sheet upper limit sensor 233, lowers the loading stage 230 as needed. Image formation operation continues, and if the quantity of the sheets P loaded on the loading stage 230 increases, as shown in FIG. 3*c*, the loading stage 230 descends according to the quantity of the sheets P. Then the stacker 2 goes into the state 2 where sheets are in the stacker. In this case, loading of the further sheet P is possible until the loading stage 230 is detected with the stage lower limit sensor 231.

Figure 3D:
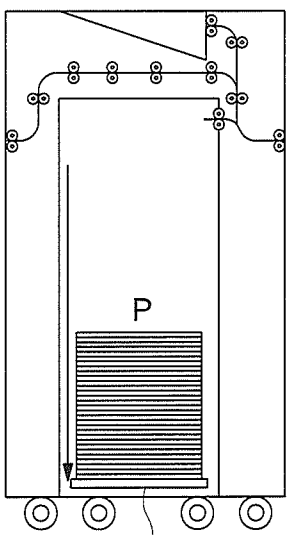
Figure 3E:
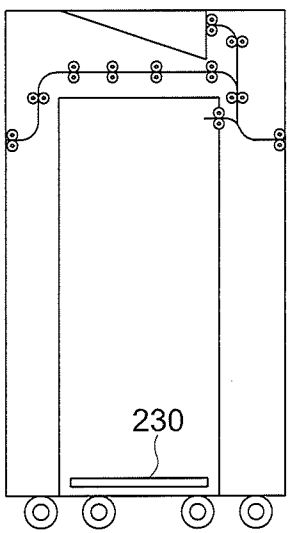

If the take-out button 200 is pushed in the state of FIG. 3*c*, the image formation operation to a new sheet is interrupted. Then, the sheets P on which image formation has been carried out including all the sheets in the middle of the conveyance are discharged on the loading stage 230. Then, as shown in FIG. 3*d*, the loading stage 230 descends to the lower limit to be detected with the stage lower limit sensor 231. If the door of the stacker 2 is opened in the state which is in shown in FIG. 3*d* and all the sheets P on the loading stage 230 are removed, it goes into the state which is shown in FIG. 3*e*. If a door is closed in the state which is shown in FIG. 3; the door having been closed is detected with the door sensor 201. Then, the loading stage 230 goes up to the upper limit to be detected with the stage upper limit sensor 232, and returns to the state which is shown in FIG. 3*a*. The door of the stacker 2 cannot usually be opened and closed due to an interlock, while image formation is being performed.

Figure 2:
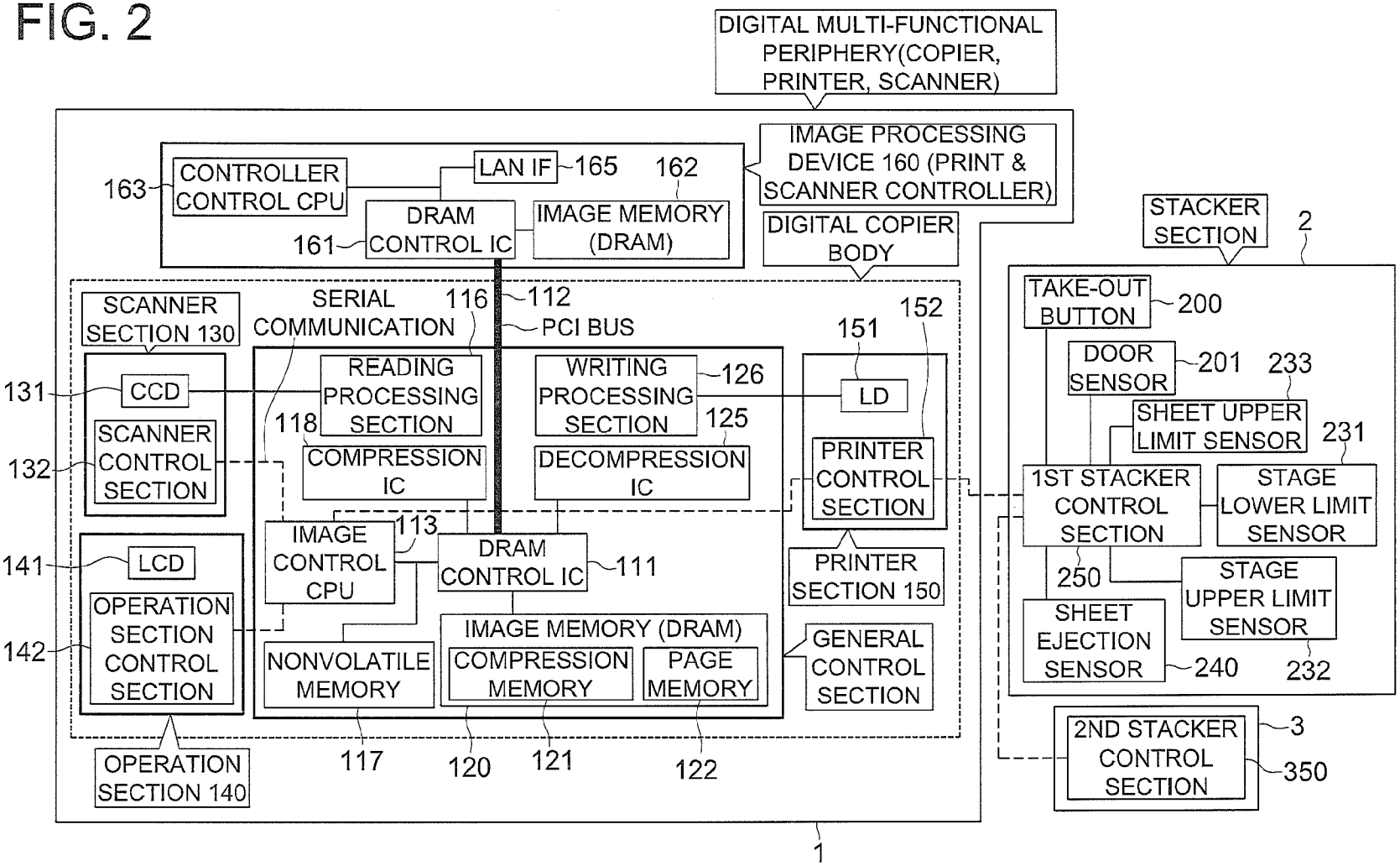
FIG. 2 shows the circuit block of the entire image forming apparatus.

In the above, based on FIGS. 1-3, the embodiment in which two stackers 2 and 3 have been arranged to be combined with the image forming apparatus 1 is described. However, the image forming apparatus 1 can also be connected with, according to an application, a post-processing apparatus for performing post processing to a sheet on which image formation has been conducted, by suitably combining, such as a side stitching process, a saddle stitching process, and a wrapping binding process.

In the mean time, if there are two or more reserved jobs when the image forming apparatus 1 performs image formation, the image formation is performed one by one according to the priority order. The priority order may be a reservation order, and the priority order of the specified job may be given a higher priority than the reservation order.

The content of the operation is transmitted to image control CPU 113 by the operation of the operation section 140 from the operation-section-control section 142. And then, in image control CPU 113, according to the content of the operation, the data about a display are transmitted to the operation-section-control section 142, and the display can be conducted on the operation section 140. Thereby, if the display on the control screen of the job is required through the operation section 140, the job control screen which displays the list, schedule, operating state of the jobs, and others can be displayed.

FIG. 4 shows the job control screen 143 where the list of reserved jobs is displayed on the operation section 140. Operating state (such as under-reservation, under-reception, under-printing, and under-holding) is displayed on this job control screen 143 about each job. Reversed display is carried out if the button of one of the job items is pushed. An operation of each operation button can perform a detailed display, alternation of the order, the precedence, selection of holding, or the like.

Figure 5:
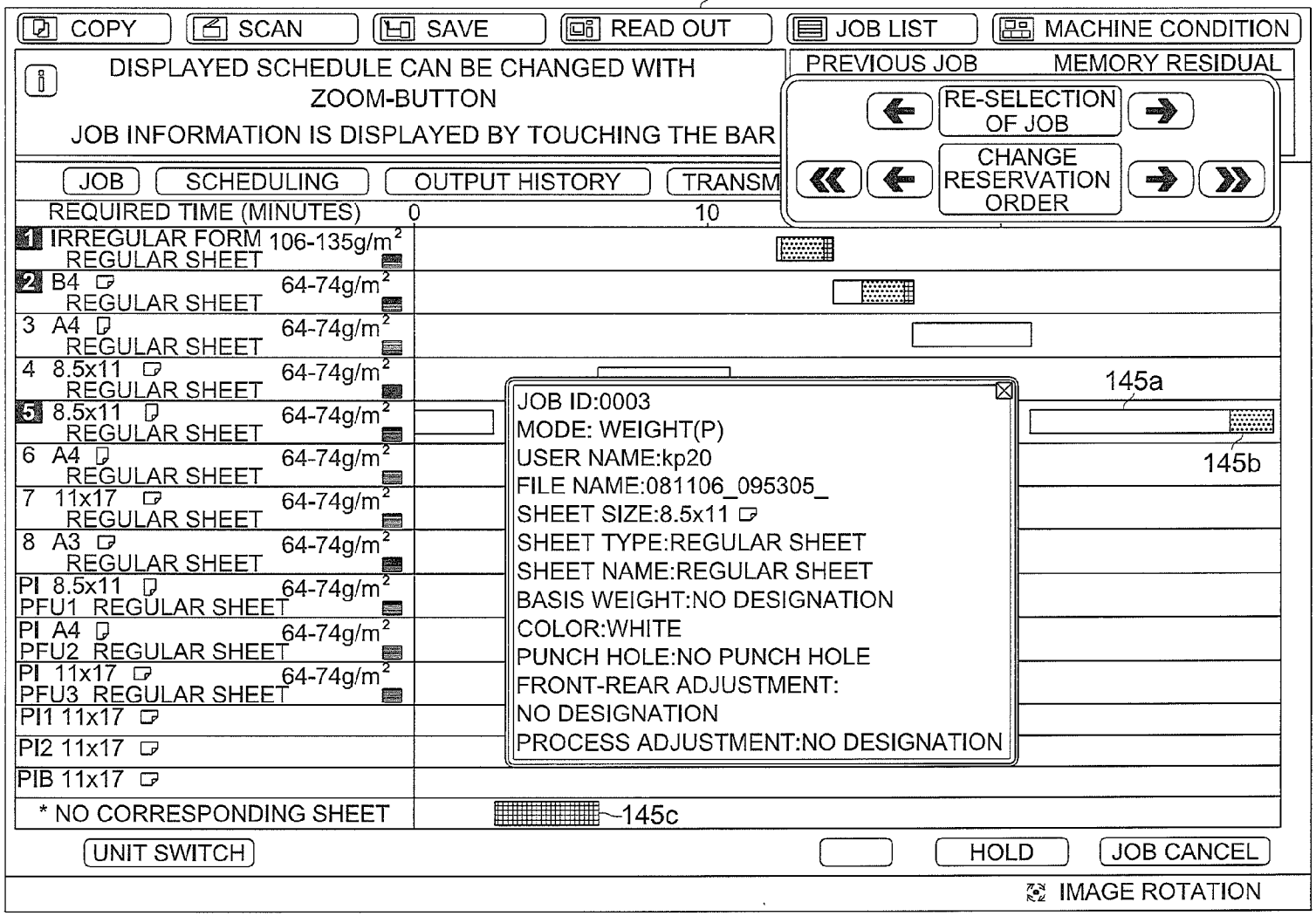
FIG. 5 shows an example of job control screen of a schedule screen.

FIG. 5 shows the job control screen 144 in which the schedule based on the reserved job on the operation section 140 is shown. The white part 145*a* in the bar charts which show the schedule on this screen shows that the process can be carried out because there is no problem in the sheet residual quantity on a sheet feed tray. The light part 145*b* of half tone dot meshing shows that image formation may stop due to the residual quantity of sheets on a sheet feed tray. It is similarly shown that image formation will stop by the dark part 145*c* of half tone line meshing due to the residual quantity of the sheets.

Further, image control-section CPU 113 creates guidance with reference to and according to the setting conditions and the operating states of jobs before and after the job in the execution order of the managed jobs, and displays it on the above-mentioned operation section 140. On the occasion of the guidance production, the content of a process for image formation processing in order not to be interrupted can be included. This guidance can be displayed on the above-mentioned operation section 140.

Here, the above-mentioned guidance is described in detail as follows. In addition below, the LS 1 indicates the stacker 2 and the LS 2 indicates the stacker 3.

Figure 6:
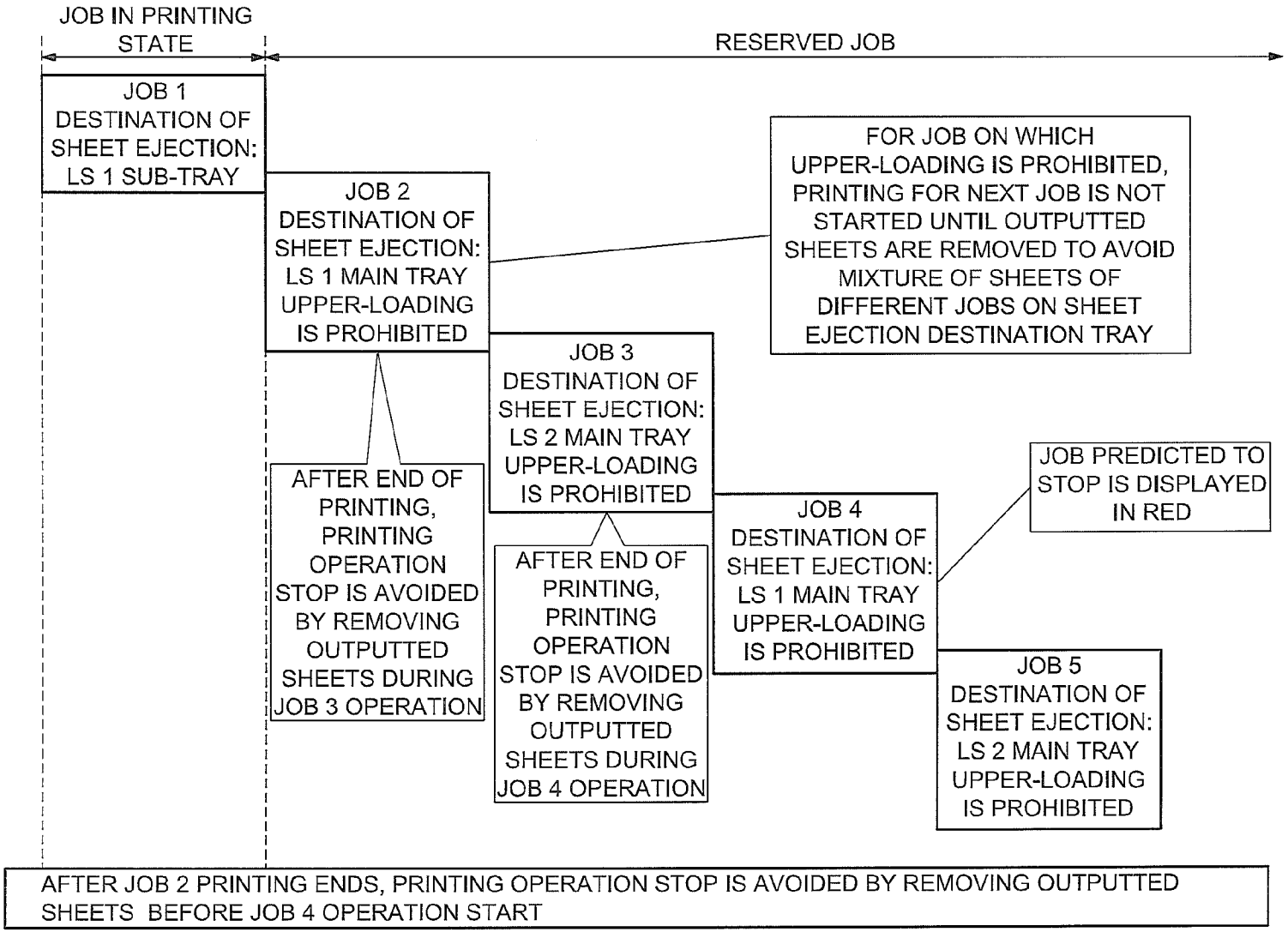
FIG. 6 shows an example of guidance for two tandem stackers (reservation JOB state).

In FIG. 6, the job 1 in the process of printing execution and jobs scheduled for execution in the order of the job 2 to the job 5 are registered. From the job 2 to the job 5, the upper loading of the sheet of other jobs is prohibited regarding the sheet ejection destination. Moreover, as a sheet ejection destination, the jobs 2 and 4 specify the LS 1 main tray. The jobs 3 and 5 specify the LS 2 main tray.

First, after the termination of printing of the job 1, the job 2 is performed and the job 3 is performed successively. Since the sheet ejection destinations of jobs 2 and 3 differ, it is not contrary to the requirements of upper loading prohibition designation of the job 2. Therefore, outputted sheets can be removed from LS 1 during the job 3 operation after the termination of a printing of the job 2. In this case, the sheet on which image formation has been carried out in the image forming apparatus 1 is conveyed to the LS 2 through the bypass route C of the LS 1. Moreover, outputted sheets can be removed from the LS 2 during the job 4 operation after the termination of a printing of the job 3.

However, in order to perform the job 4 after performing the job 3, it is necessary to remove sheets on which the image formation of the job 2 has been carried out, from the LS 1 main tray. That is, since the LS 1 main tray specified by the job 2 is specified by the job 4 as the sheet ejection destination, it is contrary to the requirements of upper loading prohibition designation of the job 2 to perform the job 4 in the state where a sheet on which the image formation of the job 2 has been carried out, is on the LS 1 main tray. The job 4 is not started until sheets of the job 2 are removed, in order to prevent mixture of the sheets of the job 2 and the job 4. Therefore, the reserved job is stopped on the way.

When the job 2 is a reserved state in process of printing of the job 1, since the time margin is large, guidance display is performed in the operation section 140, saying, "After JOB 2 printing ends, printing operation stop is avoided by removing outputted sheets before JOB 4 operation starts". The job 4 which may stop the printing is displayed in red on the list screen of the operation section or the like, and attention is called to it. According to this guidance, the user can remove the outputted sheets of job 2 from the LS 1 main tray with a margin so that a job may not be stopped.

Figure 7:
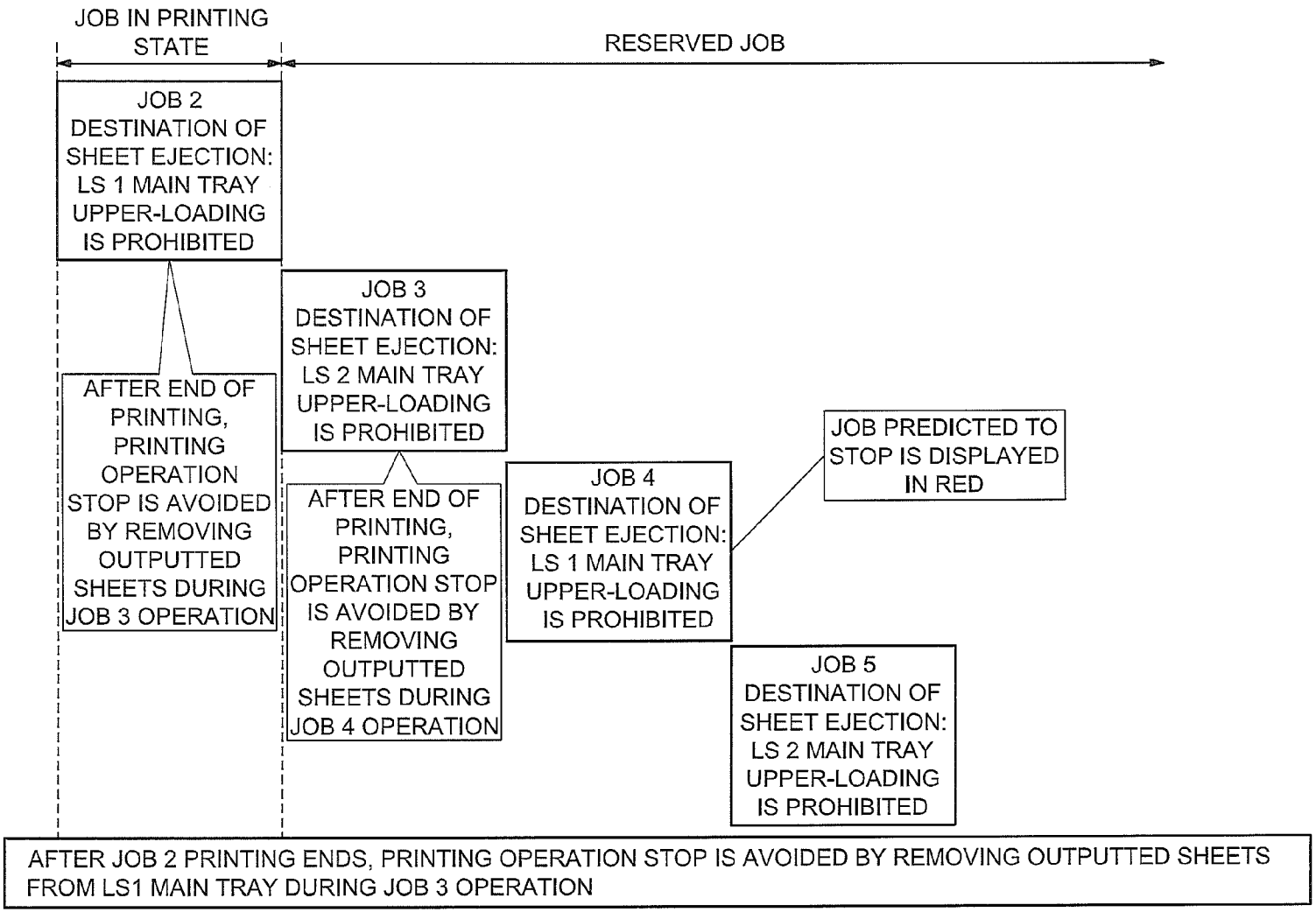
FIG. 7 shows an example of guidance for two tandem stackers (after the termination of printing of JOB 1).

On the other hand, if the printing of the job 1 is completed and the printing of the job 2 has started, compared with the above, the time margin becomes shorter. Therefore, as shown in FIG. 7, the operation section 140 changes the guidance contents, and a display of guidance is carried out as, "After JOB 2 printing ends, printing operation stop is avoided by removing outputted sheets from LS 1 main tray during JOB 3 operation". The operation section 140 urges the user to remove sheets at an early stage after the termination of printing of the job 2. The job 4 which may stop the printing is displayed in red similarly to above, and attention is called to it.

Figure 8:
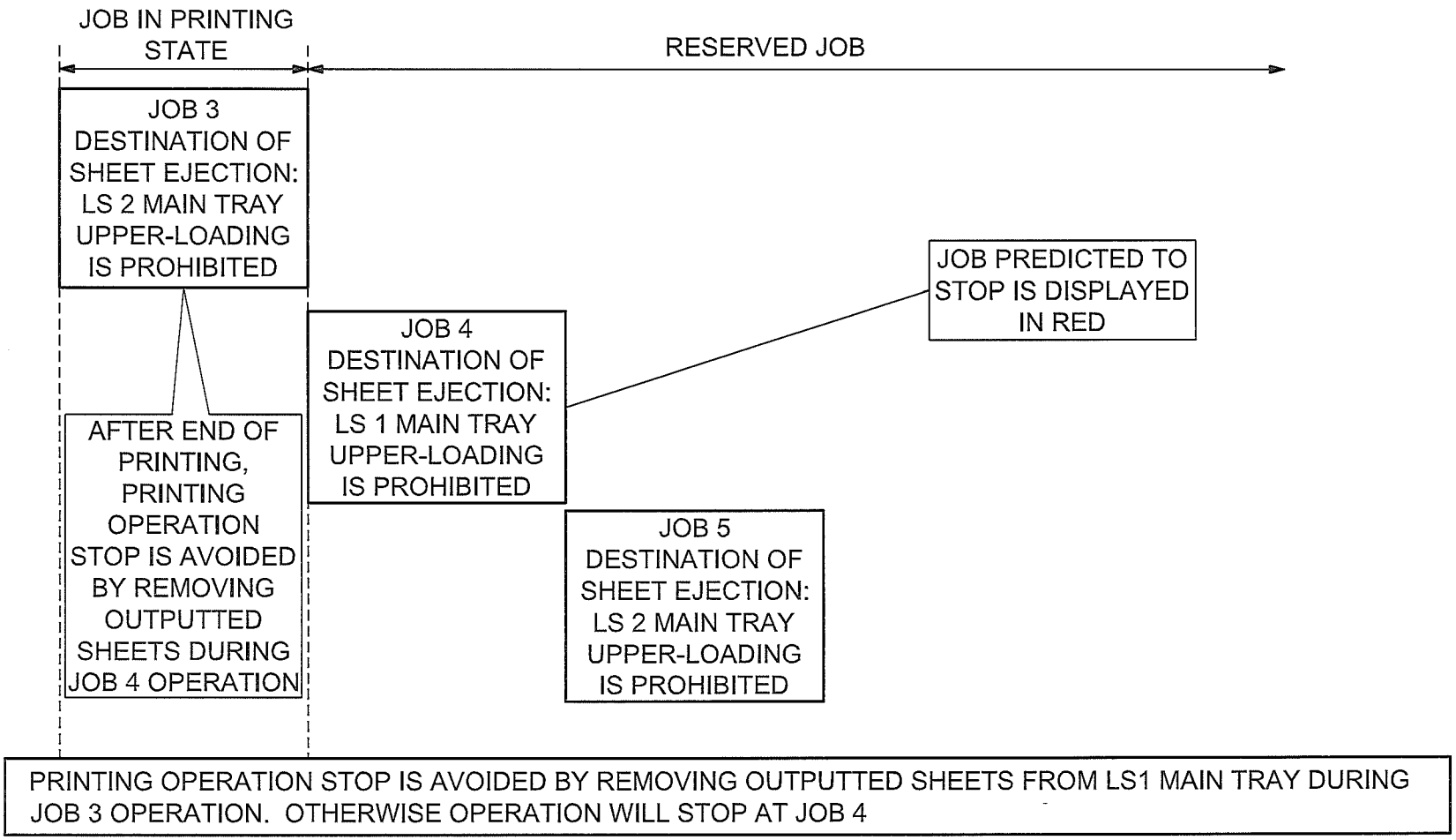
FIG. 8 shows an example of guidance for two tandem stackers (after the termination of printing of JOB 2).

Furthermore, when the job 2 is completed and the job 3 is successively performed, if the sheets on which image formation has been finished have not been removed from the LS 1 main tray, the operation section 140 changes the guidance contents and the guidance display is performed as "The printing operation stop is avoided by removing outputted sheets from LS 1 main tray during JOB 3 operation. Otherwise, operation will stop at JOB 4", as shown in FIG. 8, and attention is strongly called to it. The job 4 which may be stopped is displayed in red and attention is called to it.

Figure 9:
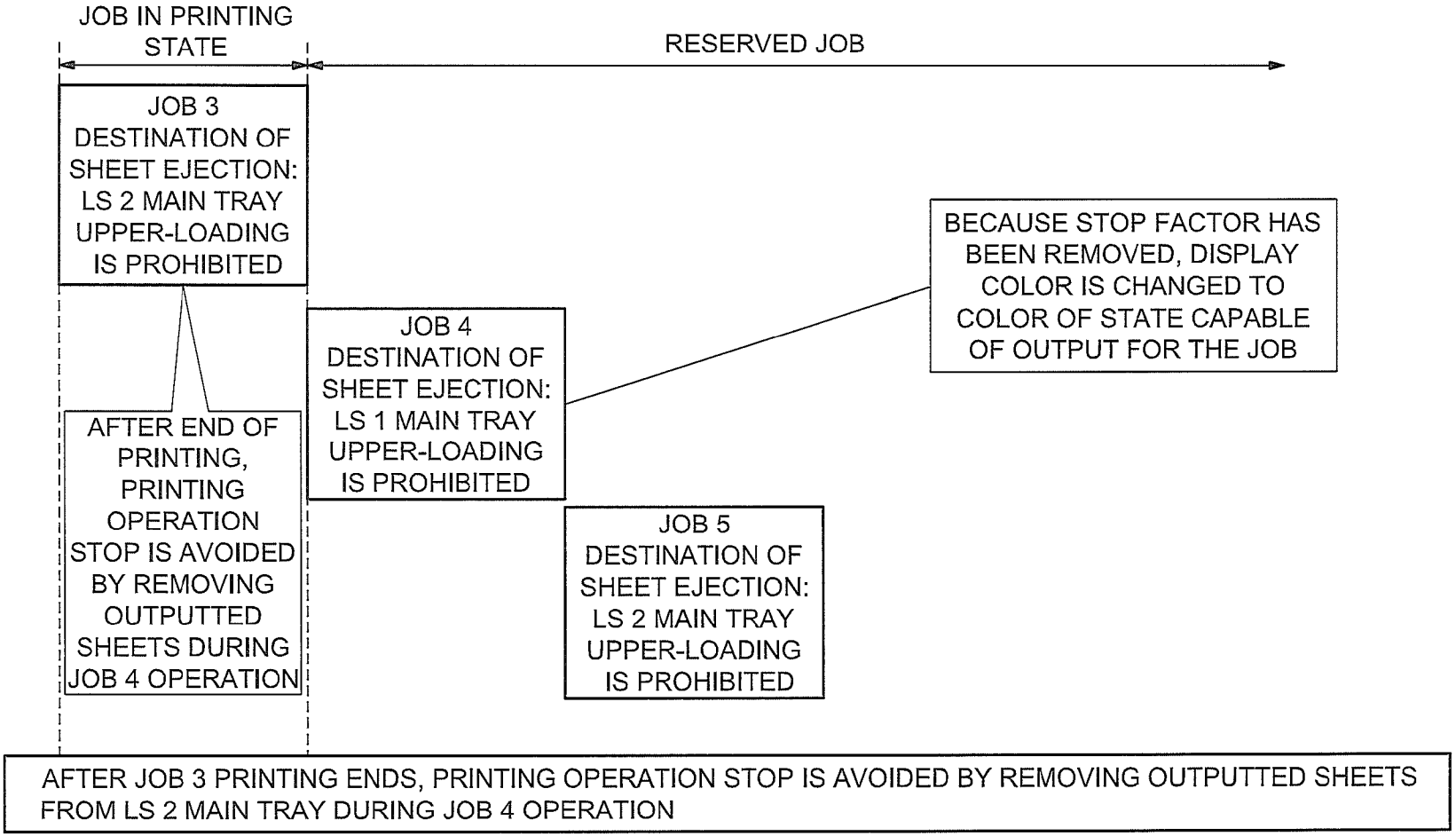
FIG. 9 shows an example of guidance for two tandem stackers (after removing outputted sheets of JOB 2 from the LS 1 main tray).

Since sheets are ejected to the LS 2 main tray with a prohibition requirement of the upper loading by the job 3, as for the job 5 for which sheets are similarly ejected to the LS 2 main tray, the job suspension is expected when the outputted sheets of the job 2 are removed from the LS 1 main tray according to the above-mentioned guidance. For this reason, as shown in FIG. 9, the operation section 140 changes the guidance to; "After JOB 3 printing ends, printing operation stop is avoided by removing outputted sheets from LS 2 main tray during JOB 4 operation". Since the suspension factor has been removed, display of red color of the job 4 is canceled and the display color is changed into a color indicating the output allowance. On the other hand, the job 5 has the possibility to stop, and it is displayed in red so that attention is called to it.

Figure 10:
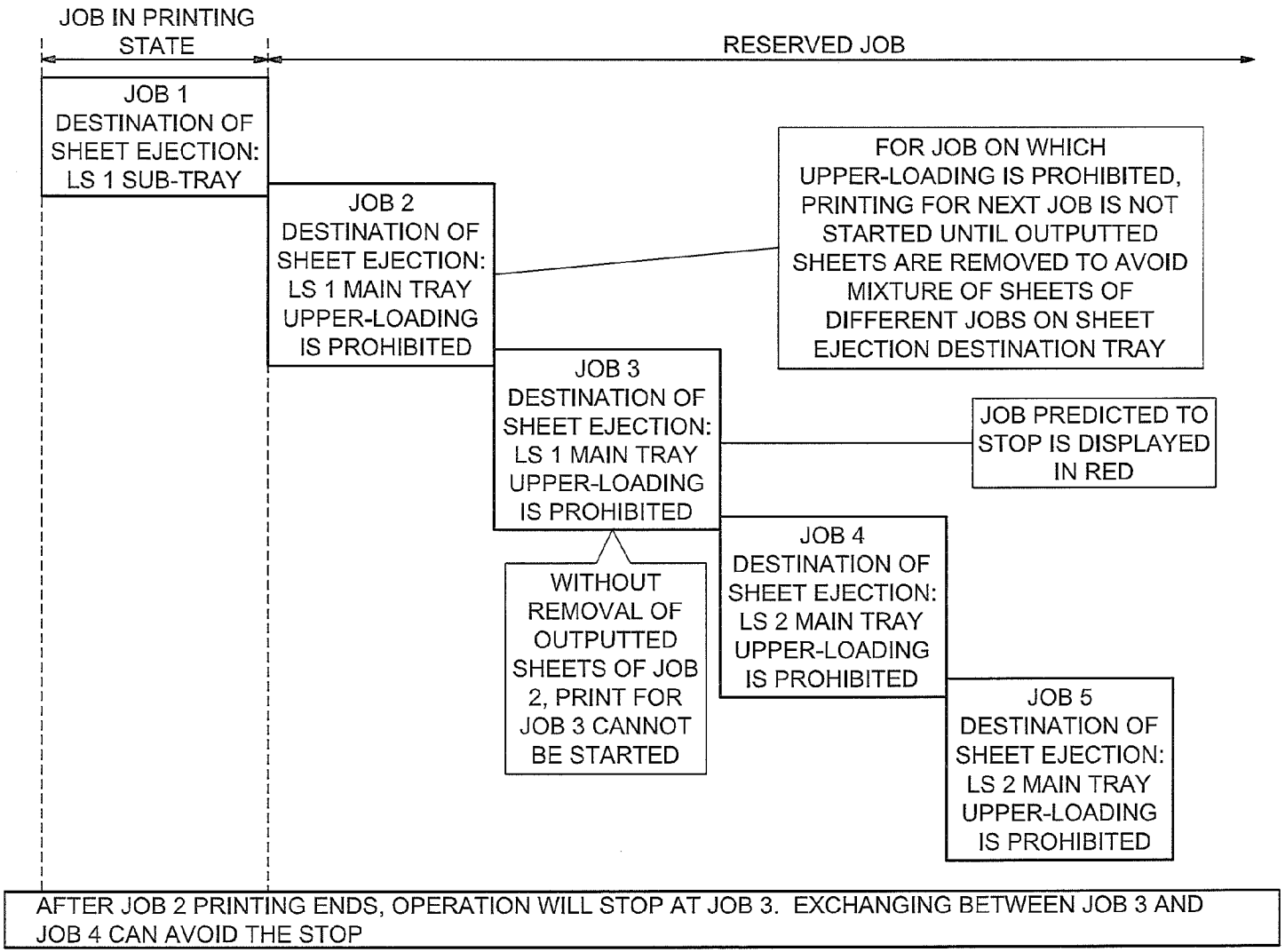
FIG. 10 shows an example of guidance for two tandem stackers (stopping of the process is avoidable by JOB exchange).

In the following example, as shown in FIG. 10, it is a case where a series of jobs are planned to be carried out, the sheet ejection on the tray on which the upper loading is prohibited. To be more specific, the sheet ejection destination of the job 1 is the LS 1 sub-tray, that of the job 2 is the LS 1 main tray, that of the job 3 is the LS 1 main tray, that of the job 4 is the LS 2 main tray, and that of the job 5 is the LS 2 main tray. Therefore, as for the job 2, the printing of the following job (job 3) is not started until the outputted sheets are removed to prevent mixing, since the job 3 whose upper loading is prohibited is intermingled with the job 2 in terms of the sheet ejection on a sheet ejection destination fray. That is, if the output sheets of the job 2 are not removed, the job 3 does not start the printing. Moreover, as for the job 4, the printing of the following job 5 is not started until the outputted sheets are removed to prevent mixing, since the job 5 whose upper loading is prohibited is intermingled with the job 4 in terms of the sheet ejection on a sheet ejection destination tray. That is, if the output sheet of the job 4 is not removed, the job 5 does not start the printing.

For this reason, the guidance display of "After JOB 2 printing ends, operation will stop at JOB 3. Exchanging between JOB 3 and JOB 4 can avoid the stop", as shown in FIG. 10, is displayed and the guidance display shows the proposed exchange plan of the reservation orders of the reserved jobs, and the exchange is urged to be done.

At this time, on the job control screen 143 or on the job control screen 144 of the operation section 140 controlled by the image control CPU 113, exchange of the reservation orders of the reserved jobs can be performed. The control screens 143 and 144 of the jobs are shown in FIGS. 4 and 5, as described above. Therefore, the orders of the jobs can be replaced by the operations on such screens.

Figure 11:
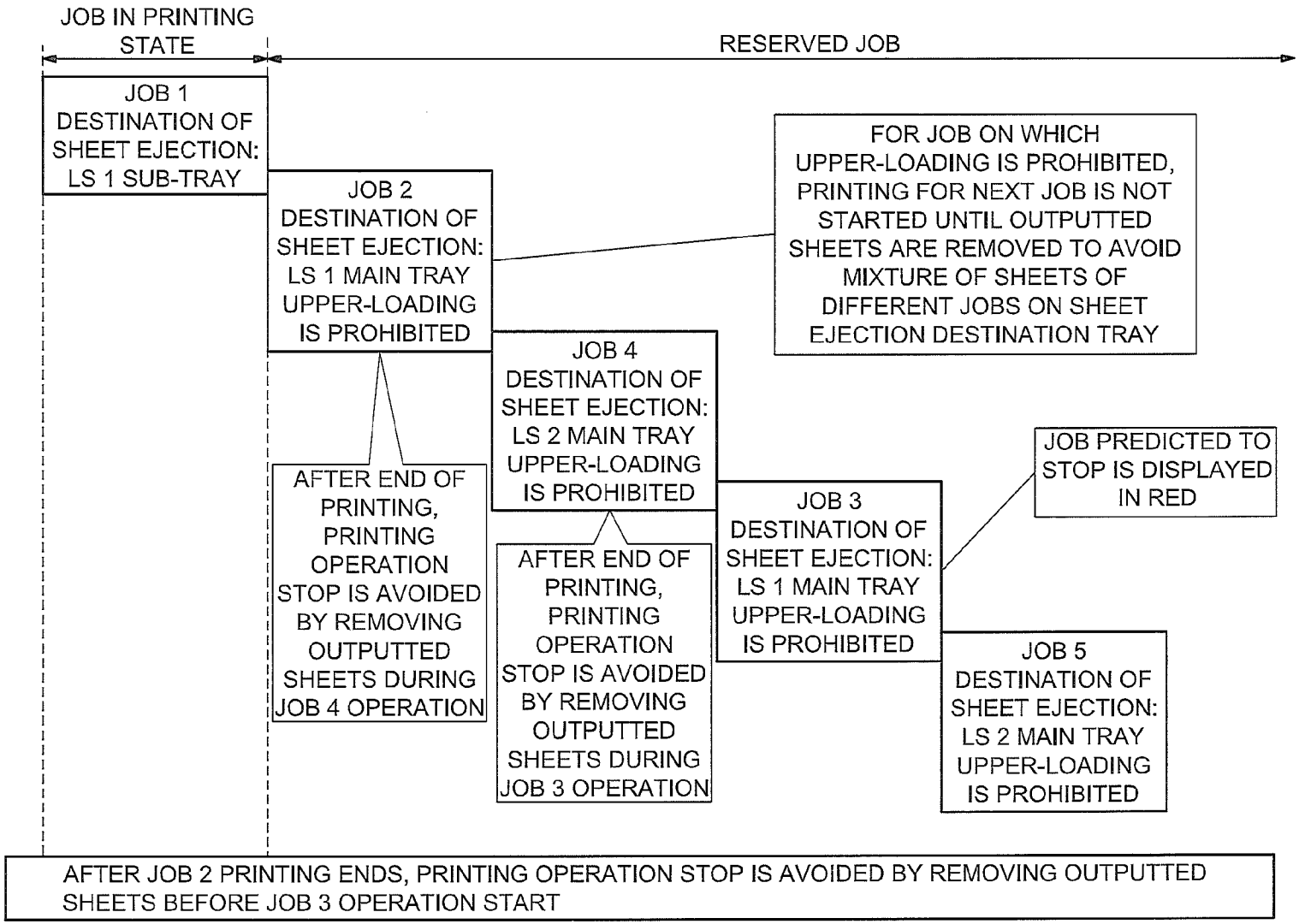
FIG. 11 shows an example of guidance for two tandem stackers (stopping of the process becomes avoidable by JOB exchange).

Then, by replacing the orders of the job 3 and the job 4 as it is shown in FIG. 11 before the time when printing of JOB 2 is completed, the guidance display is changed to; "After JOB 2 printing ends, printing operation stop is avoided by removing outputted sheets before JOB 3 operation start".

By performing removal of the outputted sheets according to the guidance display which indicates exchange of the orders of the jobs, the current job can be continued and performed after the termination of the printing of JOB 2, without stopping the image formation operation. Further, after replacing the reservation orders of the reserved jobs, since the sheet ejection destination of the job 3 and the sheet ejection destination of the job 5 are different, and no mingling occurs, the job can be continued.

Moreover, in the above-mentioned guidance display, starting or finishing time of each job can be displayed, and the time corresponding to the procedure can be displayed.

Figure 12:
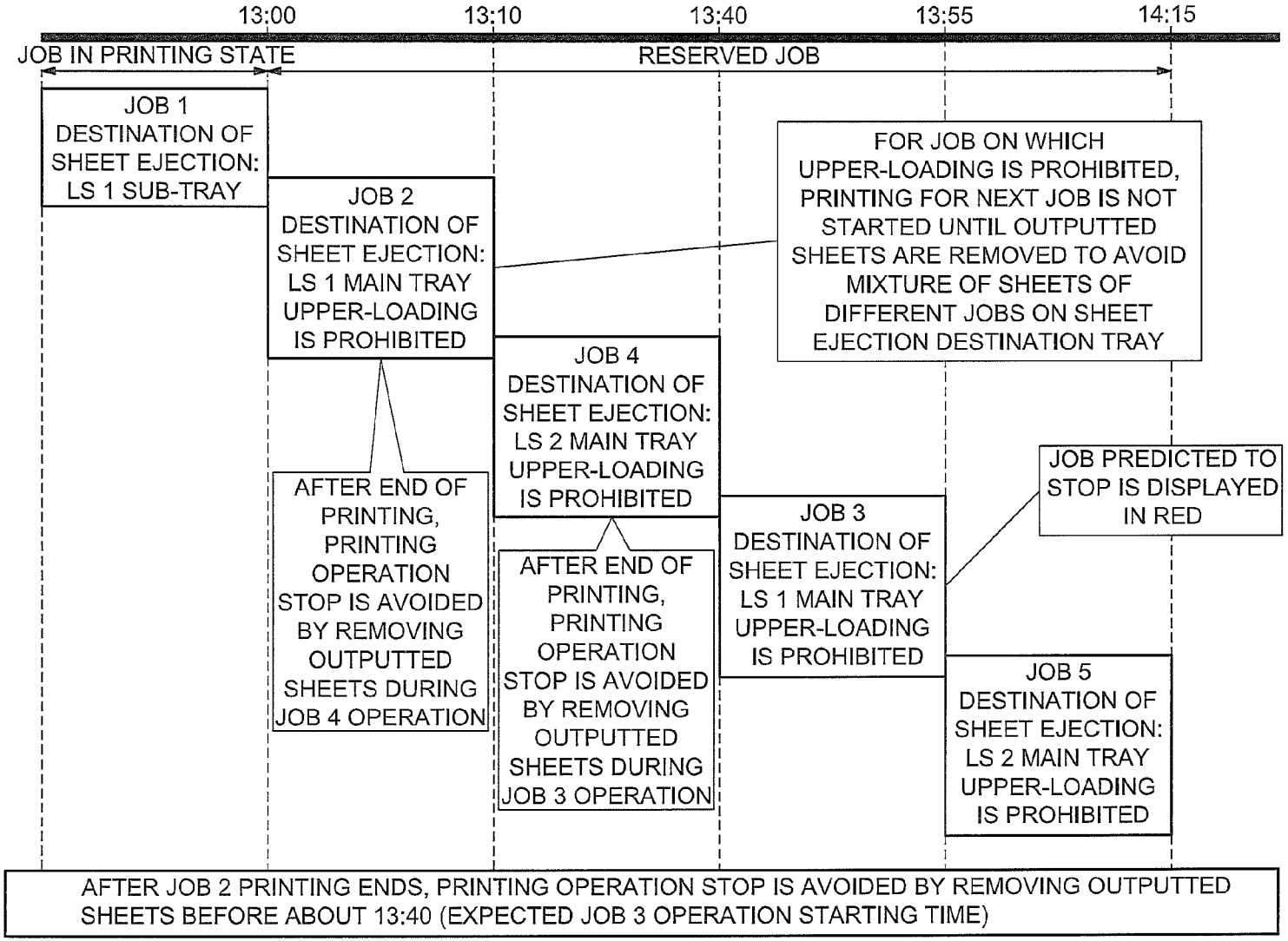
FIG. 12 shows an example of guidance for two tandem stackers (when there is a time display).

In other words, as an extension of the time for removing the outputted sheets of the job 2 in the above-mentioned guidance, as shown in FIG. 12, the printing starting time (around 13:40) of the job 3 is shown. Thereby, the guidance display urges the user to perform the removal by this time. The user can easily understand the rough indication of the extension time for the removal, and the processing becomes possible according to his/her own work schedule or the like. Time can be utilized effectively via this and working efficiency can be further improved.

Figure 13:
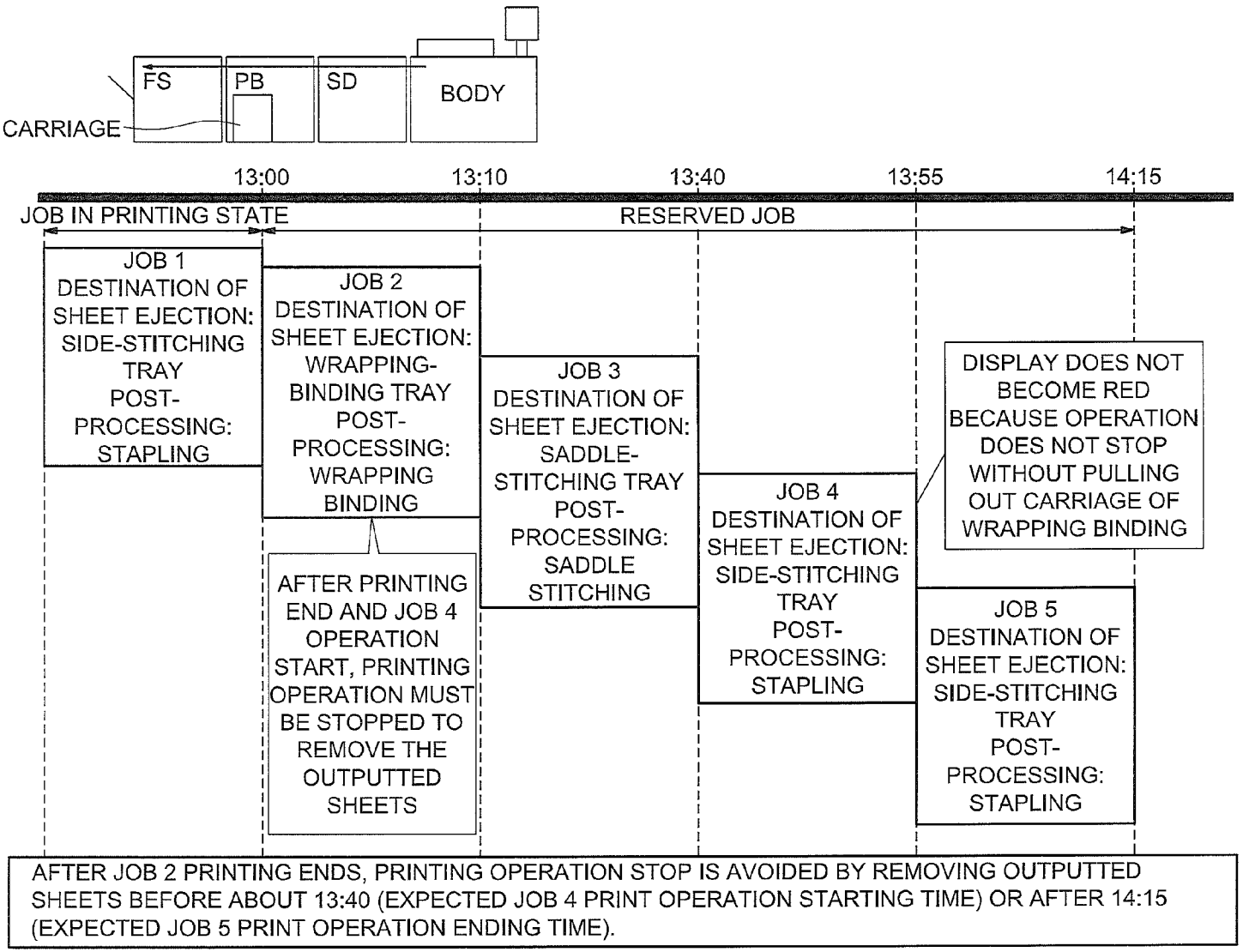
FIG. 13 shows an example of guidance for a composition of two or more post-processing apparatuses (when there is a time display).

Furthermore, if the carriage is drawn out in order to remove sheets on which image formation has been finished from the post-processing apparatus on the upstream side when the post processing method of each job is specified as shown in FIG. 13, the post-processing apparatus on the downstream side cannot carry out its post processing. Therefore, image formation stops. In this example, an SD (saddle stitching machine), a PB (wrapping binding machine) and an FS (side stitching machine) are connected on the upstream side, following the image forming apparatus. In this connected state, ejection of the sheets to the FS cannot be performed during the removal of the carriage of the PB. The carriage of the PB cannot be taken out during the sheet delivery to the FS. The taking-out is carried out after having the print operation for delivering sheets to the FS to be suspended when taking out the carriage. During the output to the saddle stitching machine, it becomes possible to draw out the carriage of the PB.

The stapling post processing which uses the side-stitching machine is done in the job 1, wrapping binding is performed with the wrapping binding machine in the job 2, saddle stitching is performed with the saddle stitching machine in the job 3, stapling post-processing is performed with the side stitching machine in the job 4, and stapling post-processing is performed with the side stitching machine in the job 5.

When the job 4 has started operating after the printing process of the job 2, in order to remove outputted sheets, it is necessary to stop the print operation for this removal for these reserved jobs. In this case, since the job 4 does not stop unless the carriage of the wrapping binding machine is pulled out, the display for the job 4 does not become a red display.

Then the guidance displays; "After JOB 2 printing ends, printing operation stop is avoided by removing outputted sheets before about 13:40 (expected JOB 4 print operation starting time) or after 14:15 (expected JOB 5 print operation ending time)", as shown in FIG. 13. The guidance display shows the time of day when it is possible to remove the outputted sheets in the wrapping binding machine.

Therefore, for the user, by following the guidance, it becomes possible to remove outputted sheets from the wrapping binding machine without stopping the image formation on the way.

Figure 14:
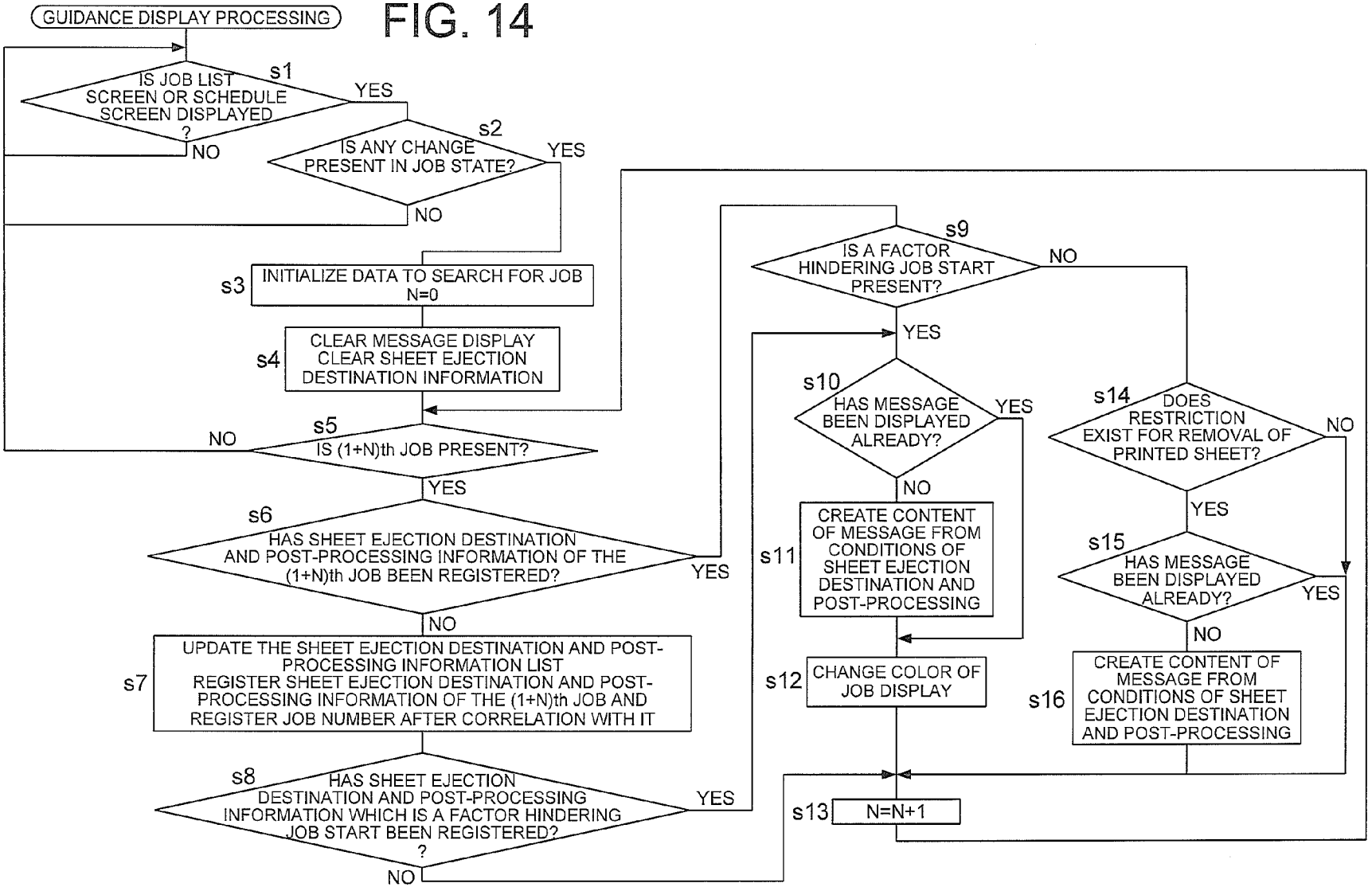
FIG. 14 is a flow chart in which the procedure of the guidance display process is shown.

Moreover, the image control CPU 113 judges the content of the reserved jobs, and the above-mentioned guidance is displayed on the operation section 140. In image control CPU 113, the guidance display processing of the procedure shown in FIG. 14 is performed.

In other words, in this guidance displaying processing, first it is judged whether a list display or a schedule display of the job is carried out on the job control screen (Step s1). And then the image control CPU 113 stands by until this control screen is displayed (Step s1, NO). When a list display or schedule display is being carried out (Step s1, YES), it is judged whether the states of reserved jobs have changed (Step s2). As a case where the states of reserved jobs have changed, the case where a registration of a new job, deletion of a job, printing start, termination of printing or exchange of the orders of the jobs, or removal of the operation suspension factor of the above-mentioned image formation is cited, for example. If there is no change in the states of the jobs, it returns to Step s1.

When the state of the job has changed (Step s2, YES), the data for retrieving the job are initialized (set as N=0) (Step s3).

The message display and sheet ejection destination information are cleared after the above-mentioned initialization (Step s4). Subsequently, existence of the Nth job from the first job is checked (Step s5). When the Nth job from the first job ((1+N)th job) does not exist (Step s5, NO), it returns to Step s1.

When the Nth job from the first job ((1+N)th job) exists (Step s5, YES), it is judged whether the sheet ejection destination or post processing information on the job is registered (Step s6).

When the sheet ejection destination or post processing information on the job is not registered (Step s6, NO), the sheet ejection destination and post processing information list are updated. To be specific, the information of the sheet ejection destination and post processing of the Nth job from the first job ((1+N)th job) is related with the job number, and is registered (Step s7). This information is registered into the nonvolatile memory 117 or the like. Subsequently, it is judged whether the information of the sheet ejection destination and post processing, which becomes a factor which interferes with the job start, is registered (Step s8). If this information has not been registered (Step s8, NO), 1 is added to N (Step s13). Then similar determination processing about the following job is performed (to Step s5). When the information of the sheet ejection destination and post processing, which become a factor which interferes with start of the job, is registered (Step s8, YES), the process shifts to Step s10 where it is judged whether the message is already displayed on the operation section.

Further, when it is judged that the information of the sheet ejection destination and post processing of the Nth job from the first job ((1+N)th job) is registered at the above-mentioned Step s6 (Step s6, YES), it is judged whether the factor which interferes with start of the job exists (Step s9). If the factor exists, the process goes to the above-mentioned Step s10.

At Step s10, when it is not judged that the message is already displayed (Step s10, NO), a message is created according to the requirements of the sheet ejection destination and post processing (Step s11). The display color of the job is then changed so that the display color of the job, whose start is impossible may be made to be red as described above, and the display color of the job whose start has become possible, may be changed into a normal color (Step s12). The process then shifts to Step s13. When the message is already created (Step s10, YES), the display color of the JOB is changed similarly to the above, without creating the message (Step s12). After that, 1 is added to N (Step s13), and similar determination processing about the following job is performed (to Step s5).

On the other hand, when it is judged that a factor making job start impossible does not exist at the above-mentioned Step s9 (Step S9, NO), it is judged whether restrictions occur in the removal of the printed matter (Step s14). If restrictions have not occurred, 1 is added to N similarly to the above (Step s13), and similar determination processing about the following job is performed (to Step s5).

When restrictions have occurred in the removal of the printed matter, it is judged whether a message is already displayed (Step s15). If a message has been displayed (Step s15, YES), 1 is added to N (Step s13), and similar determination processing about the following job is performed (to Step s5). If a message is not displayed (Step s15, NO), the content of the message is created according to the requirements of the sheet ejection destination and post processing, and 1 is added to N (Step s13). Similar determination processing about the following job is then performed (to Step s5).

Via the above, a message according to the situation can be created and changed according to the change of the state of the job.

As mentioned previously, although the present invention has been described based on the above embodiment, the present invention is not limited to a description of the above-mentioned embodiment. Proper modifications are possible unless they deviate from the extent of the present invention.

As described above, according to the image forming apparatus of an embodiment of the present invention, the image forming apparatus has an image forming section which performs image formation according to execution of the job, a storage section which can store two or more jobs, a display section to perform display, and the a control section by which the operations of the above-mentioned image formation section and the above-mentioned display section are controlled, and the above-mentioned job is stored and managed in the above-mentioned storage section, and which performs these two or more jobs in the prescribed order. The above-mentioned control section creates guidance according to the setting conditions and the operating state of each of jobs before and after the job in the execution order and displays this guidance on the above-mentioned display section. Therefore, according to, or referring to, the guidance, the user can perform processes. Working efficiency can be enhanced because the operator knows easily a process or timing required in order to operate without stopping printing operation. Furthermore, several sets of printing data whose settings differ can be made to be outputted without stopping the operation.

What is claimed is:

1. An image forming apparatus, comprising:

an image forming section which performs image formation according to execution of a job;

a storage section which can store a plurality of jobs;

a display section which conducts display; and a control section which makes the storage section to store the job so as to control the job and which executes the plurality of jobs in a prescribed execution order as well as controlling operations of the image forming section and the display section, wherein the control section creates guidance according to a setting condition and an operating state of each of jobs before and after the job in the execution order and makes the display section to display the guidance thereon.

2. The image forming apparatus of claim 1, wherein a post-processing apparatus can be connected to the image forming apparatus, the post-processing apparatus performing post processing for a sheet on which the image formation has been carried out in the image forming section.

3. The image forming apparatus of claim 2, wherein the setting condition is post-processing setting information which specifies a post-processing method of a sheet on which the image formation has been carried out.

4. The image forming apparatus of claim 1, wherein the setting condition is sheet ejection destination setting information which specifies a sheet ejection destination of a sheet on which the image formation has been carried out.

5. The image forming apparatus of claim 1, wherein the operating state is a reservation state of a job, an execution state of a job, a finishing state of a job, the execution order of a job, or existence of an image formation suspension factor.

6. The image forming apparatus of claim 1, wherein the guidance is an indication of a procedure for enabling the operation of the image formation to continue without suspending the operation.

7. The image forming apparatus of claim 6, wherein the procedure shows an exchange plan which urges exchange of execution orders of the jobs.

8. The image forming apparatus of claim 6, wherein the guidance is the indication displayed while correlating the procedure with time.

9. The image forming apparatus of claim 1, wherein when the setting condition or the operating state of each of the jobs has a change after the control section creates the guidance, the control section changes the guidance according to the setting condition and the operating state each of the jobs before and after the job in the execution order.

10. The image forming apparatus of claim 9, wherein the change of the operating state of each of the jobs is at least one of a registration of a new job, deletion of a job, execution of a job, termination of a job or exchange of jobs in the execution order, and a resolution of an operation suspension factor of the image formation.

11. The image forming apparatus of claim 1, wherein the display section displays a list or a schedule of the jobs.

12. The image forming apparatus of claim 1, further comprising:

an operation section which can perform the operations for the jobs.

13. An image forming method, comprising the steps of:

performing image formation according to execution of a job;

storing a plurality of jobs;

controlling the plurality of jobs;

executing the plurality of jobs in a prescribed execution order;

creating a guidance according to a setting condition and an operating state of each of jobs before and after a job in the execution order;

displaying the guidance; and controlling operations of the image formation and the display.

14. The image forming method of claim 13, wherein the setting condition is sheet ejection destination setting information which specifies a sheet ejection destination of a sheet on which the image formation has been carried out.

15. The image foaming method of claim 13, wherein the setting condition is post-processing setting information which specifies a post-processing method of a sheet on which the image formation has been carried out.

16. The image forming method of claim 13, wherein the operating state is a reservation state of a job, an execution state of a job, a finishing state of a job, the execution order of a job, or existence of an image formation suspension factor.

17. The image forming method of claim 13, wherein the guidance is an indication of a procedure for enabling the operation of the image formation to continue without suspending the operation.

18. The image forming method of claim 17,
wherein the procedure shows an exchange plan which urges exchange of execution orders of the jobs.

19. The image forming method of claim 17,
wherein the guidance is the indication displayed while correlating the procedure with time.

20. The image forming method of claim 13,
wherein when the setting condition or the operating state of each of the jobs has a change after the guidance is created, the guidance is changed according to the setting condition and the operating state of each of the jobs before and after the job in the execution order.

21. The image forming method of claim 20,
wherein the change of the operating state of each of the jobs is at least one of a registration of a new job, deletion of a job, execution of a job, termination of a job or exchange of jobs in the execution order, and a resolution of an operation suspension factor of the image formation.

22. The image forming method of claim 13,
wherein a list or a schedule of the jobs is displayed.

23. An image forming apparatus, comprising:
an image forming section which performs image formation according to execution of a job;
a storage section which can store a plurality of jobs;
a display section which conducts display; and
a control section which makes the storage section to store the job so as to control the job and which executes the plurality of jobs in a prescribed execution order as well as controlling operations of the image forming section and the display section,
wherein the control section creates one or more suggested steps for reducing a delay in execution of at least one of the plurality of jobs according to a setting condition and an operating state of each of jobs before and after the job in the execution order and makes the display section to display the one or more suggested steps thereon.

24. The image forming apparatus of claim 23,
wherein a post-processing apparatus can be connected to the image forming apparatus, the post-processing apparatus performing post processing for a sheet on which the image formation has been carried out in the image forming section.

25. The image forming apparatus of claim 24,
wherein the setting condition is post-processing setting information which specifies a post-processing method of a sheet on which the image formation has been carried out.

26. The image forming apparatus of claim 23,
wherein the setting condition is sheet ejection destination setting information which specifies a sheet ejection destination of a sheet on which the image formation has been carried out.

27. The image forming apparatus of claim 23,
wherein the operating state is a reservation state of a job, an execution state of a job, a finishing state of a job, the execution order of a job, or existence of an image formation suspension factor.

28. The image forming apparatus of claim 23,
wherein the display section displays a list or a schedule of the jobs.

29. The image forming apparatus of claim 23, further comprising:
an operation section which can perform the operations for the jobs.z

* * * * *